United States Patent [19]

Balkan

[11] 4,419,103

[45] Dec. 6, 1983

[54] METHOD AND APPARATUS FOR COLORING EASTER EGGS

[76] Inventor: Thelma E. Balkan, 17 Jefferson St., Pinehurst, Mass. 01866

[21] Appl. No.: 940,392

[22] Filed: Sep. 7, 1978

[51] Int. Cl.[3] ..... B05C 11/08; D06P 5/20

[52] U.S. Cl. ..... 8/506; 118/18; 118/219; 118/264; 427/242; 427/274; 427/277; 427/346

[58] Field of Search ..... 427/242, 256, 271, 280, 427/346, 429, 274, 277; 118/268, 264, 219, 221, 222, 13, 212, 18, 56; 8/3, 5, 506; 426/250, 300; 15/21 A

[56] References Cited

U.S. PATENT DOCUMENTS

| | | | |
|---|---|---|---|
| 439,031 | 10/1890 | Dyke | 427/242 |
| 1,087,005 | 2/1914 | Fedderson | 15/21 A |
| 2,039,548 | 5/1936 | Moore | 427/346 X |
| 2,624,900 | 1/1953 | Smith | 15/21 A |
| 2,840,842 | 7/1958 | Kaheny | 427/242 X |
| 3,562,830 | 2/1971 | Ruedisueli | 15/21 A |
| 3,745,973 | 7/1973 | Knecht | 118/400 |

FOREIGN PATENT DOCUMENTS

| | | | |
|---|---|---|---|
| 1260031 | 1/1972 | United Kingdom | 118/264 |

*Primary Examiner*—Evan K. Lawrence

[57] ABSTRACT

Apparatus and method for coloring or patterning Easter eggs in which a dish-shaped container having an inner surface that is non-absorbent of liquid dye is provided with inwardly-extending projections adapted to receive coloring dye. The egg to be patterned is coated with coloring material and, while the material remains wet, is rolled around the interior of the container by a swirling motion.

3 Claims, 4 Drawing Figures

METHOD AND APPARATUS FOR COLORING EASTER EGGS

BACKGROUND OF THE INVENTION

This invention relates to an apparatus and method for the coloring of Easter Eggs by youngsters as a form of seasonal entertainment.

Hard boiled eggs, or empty egg shells, are traditionally colored by youngsters as an Easter ritual. The most usual procedure is merely to immerse the egg in liquid vegetable dye. One-time stencils or transfers are widely used to produce patterns on such eggs, but reusable devices are not in general use.

SUMMARY OF THE INVENTION

The invention comprises a method and apparatus for coloring Easter eggs in which the eggs are swirled while wet with liquid dye inside a container having numerous spaced projections from a surface that is non-absorbent of the liquid dye.

It is an object of this invention to provide a simple method and apparatus for producing attractive patterns on Easter eggs.

It is another object to provide a reusable container having inwardly-extending projections which absorb and distribute or redistribute coloring dye over the surface of an egg as it is rolled around in the container.

It is still another object to provide such a container in which each inwardly-extending projection is tipped with or formed from sponge or other resilient material capable of absorbing liquid dye.

It is yet another object of this invention to provide a process for producing a colored pattern on an egg by swirling the egg, while exposed to a liquid dye, around in a dish-shaped container having a number of internally-extending projections.

DESCRIPTION OF THE PREFERRED EMBODIMENTS

Figure 1:
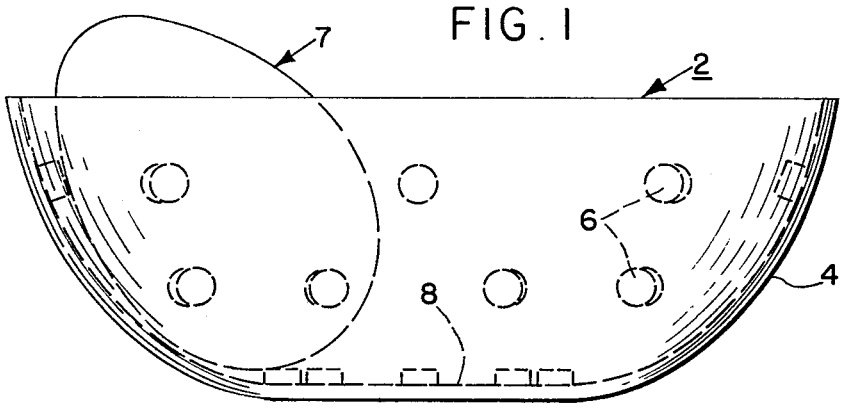
FIG. 1 is an elevational view of a dish having internal projections or buttons for distributing the dye.
Figure 2:
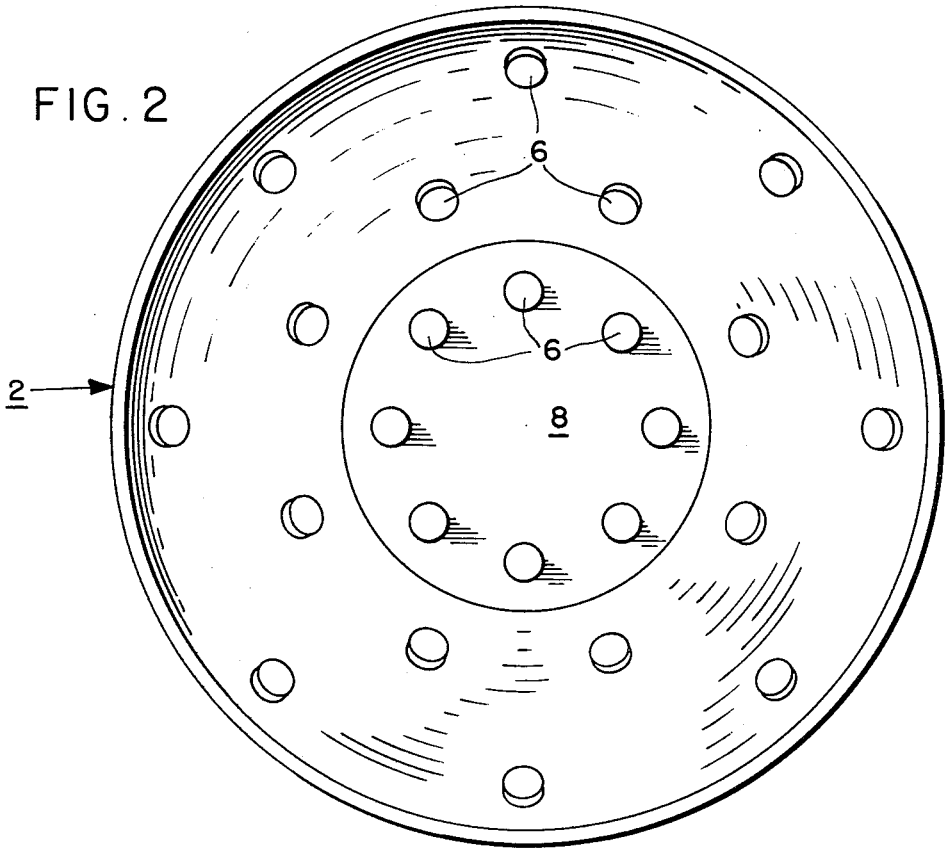
FIG. 2 is a plan view of the dish shown in FIG. 1.
Figure 4:
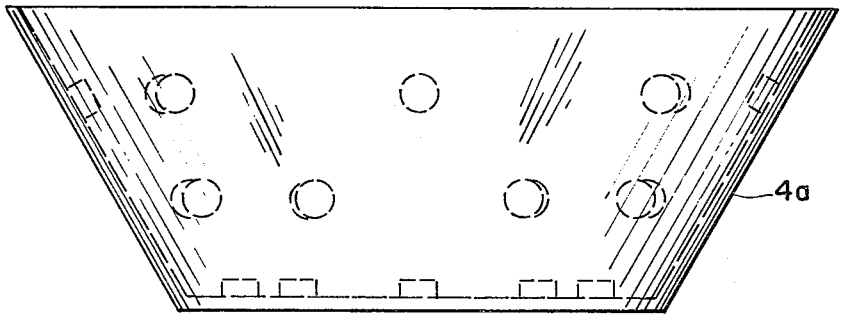
FIG. 4 is an elevational view showing a dish having linear sloping sides.

A dish, generally indicated at 2, which may be of any desired dimensions such as 6–8 inches in diameter and $1\frac{1}{2}$ to 3 inches in depth, is provided with a sloping side wall 4. This wall may be concave in section as illustrated in FIG. 1, or it may be linear as shown at 4*a* in FIG. 4. I prefer the concave shape, however, as it provides more effective contact with the surface of the egg. Similarly, the bottom may be concave, or flat as shown in FIGS. 1, 2 and 4.

The inner surface of the dish 2, formed of material that is non-absorbent of liquid dye, is provided with integral inwardly-extending projections or buttons 6. These buttons are spaced over the internal surface of the dish in any desired pattern and spacing. I have found that a spacing of one or two inches is satisfactory for most uses. The buttons 6 are preferably of uniform height and need be only an eighth of an inch or so in height, although buttons of greater thickness may be used if desired.

In a preferred method of use, a few drops of liquid dye are applied to the surface of the egg, illustrated diagrammatically at 7 in FIG. 1, and while the dye remains wet the egg is placed as shown in the dish 2. The dish is then swirled by hand motion to cause the egg to roll around the perimeter of the dish and make contact with the buttons 6. The tips of the buttons will pick up and redistribute increments of the dye to produce a pleasing and attractive pattern. Alternatively, the dye may be applied to the faces of the buttons and then transferred to the egg surface by the swirling motion. Or, the egg may be immersed in liquid dye and, while still wet, rolled around in the dish 2.

A wide variety of patterns and coloring effects may be produced, dependent upon the particular design of the dish, the consistency of the dye, the length of time the egg is swirled in the dish, and the characteristics of the particular agitating motion.

Figure 3:
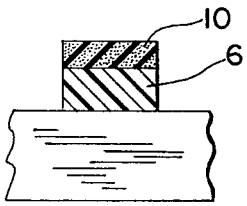
FIG. 3 is an enlarged sectional view of one of the projections or buttons showing the resilient face.

The dish 2 may be formed, for example, from plastic with the buttons molded integrally with the dish. For improved operation, I prefer that the tip 10 (see FIG. 3) of each button 6 be formed of resilient material, such as sponge, felt, cloth, plastic foam or other material capable of absorbing a small amount of the dye. This may be accomplished by cementing a layer of such absorbent material to the surface of each projection 6, or the entire projection may be formed of the absorbent material. The dish 2 may be formed, for example, with a smooth inner surface and the buttons produced by cementing small pieces of sponge or other material to the inner surface. Each button may be formed by a circular piece of sponge 3/16 inch or so in diameter and about $\frac{1}{8}$ inch in thickness. The surface areas of the projections 6 may have any desired shape such as circular, square, oval, etc.

The projections 6 may be distributed over the wall 4 and the bottom 8 of the dish, as shown in FIG. 1, or they may be omitted from the bottom and placed only on the side wall.

From the foregoing, it will be seen that my invention is well adapted to attain the ends and objects herein set forth, that it is capable of economical manufacture, and that it is subject to a wide variety of modifications to best suit it to the conditions of each particular use.

I claim:

1. Apparatus for coloring Easter eggs with a liquid dye comprising a generally dish-shaped container having a bottom and an outwardly sloping side wall, the inner exposed surface being formed predominately of material non-absorbent to liquid dye and having on said bottom and on said side wall a plurality of inwardly-extending projections each having an exposed substantially planar tip surface of resilient material capable of absorbing liquid, the inner ends of said projections being separated by a substantial distance from the inner ends of adjacent projections.

2. Apparatus as claimed in claim 1 wherein the diameter of said dish-shaped container is between six and eight inches.

3. The method of coloring Easter eggs comprising the steps of providing a container having a bottom and an outwardly sloping side wall, the inner surfaces thereof being predominately non-absorbent to liquid dye, said bottom and said side wall each having a plurality of spaced inwardly-extending projections thereon, the diameter of said dish being substantially greater than the diameter of the Easter egg to be colored, exposing an Easter egg to liquid dye, and redistributing increments of said dye by swirling said egg, while wet with the liquid dye, around the inside of said container in successive momentary contact with said projections on said side wall and on said bottom.

* * * * *